US007722323B2

(12) United States Patent
Elsmark

(10) Patent No.: US 7,722,323 B2
(45) Date of Patent: May 25, 2010

(54) AXIAL FLOW TURBINE WITH OVERSPEED PREVENTING DEVICE

(75) Inventor: Karl Johan Lars Elsmark, Saltsjö-Boo (SE)

(73) Assignee: Atlas Copco Tools AB, Nacka (SE)

( * ) Notice: Subject to any disclaimer, the term of this patent is extended or adjusted under 35 U.S.C. 154(b) by 541 days.

(21) Appl. No.: 11/720,065

(22) PCT Filed: Nov. 23, 2005

(86) PCT No.: PCT/SE2005/001757

§ 371 (c)(1),
(2), (4) Date: May 23, 2007

(87) PCT Pub. No.: WO2006/057602

PCT Pub. Date: Jun. 1, 2006

(65) Prior Publication Data

US 2008/0038108 A1 Feb. 14, 2008

(30) Foreign Application Priority Data

Nov. 23, 2004 (SE) ..... 0402850

(51) Int. Cl.
*F01D 7/02* (2006.01)

(52) U.S. Cl. ..... 416/45; 416/62; 416/146 R; 416/169 R

(58) Field of Classification Search ..... 415/173.1, 415/123, 173.4, 174.4; 416/146 R, 169 R, 416/224, 45, 32, 52, 62
See application file for complete search history.

(56) References Cited

U.S. PATENT DOCUMENTS

| | | | | |
|---|---|---|---|---|
| 2,987,296 A | | 6/1961 | Ferguson, Jr. | |
| 3,128,989 A | | 4/1964 | Allingham | |
| 3,856,432 A | * | 12/1974 | Campagnuolo et al. | 416/45 |
| 4,507,047 A | | 3/1985 | Coons | |
| 4,540,337 A | * | 9/1985 | Olsen | 415/141 |

FOREIGN PATENT DOCUMENTS

| | | |
|---|---|---|
| GB | 629776 A | 9/1949 |
| GB | 2128685 A | 5/1984 |

* cited by examiner

*Primary Examiner*—Edward Look
*Assistant Examiner*—Dwayne J White
(74) *Attorney, Agent, or Firm*—Frishauf, Holtz, Goodman & Chick, P.C.

(57) ABSTRACT

An axial flow turbine motor is provided which includes a rotor with a peripheral row of drive blades and a peripheral band-shaped wall element radially clamped against the tops of the drive blades, and a housing with at least one pressure medium inlet nozzle and an annular inner surface surrounding the rotor drive blades and the wall element, wherein the wall element is arranged to withstand centrifugal forces and uphold its clamping engagement with the drive blades at rotor speed levels up to a predetermined speed level, but to expand and loosen its clamping engagement with the drive blades at speed levels above the predetermined speed level, thereby moving into contact with the annular surface and interfering with the rotational movement of the rotor so as to prevent the rotor from reaching hazardous high speed levels.

4 Claims, 2 Drawing Sheets

AXIAL FLOW TURBINE WITH OVERSPEED PREVENTING DEVICE

This application is a U.S. National Phase Application under 35 USC 371 of International Application PCT/SE2005/001757 filed Nov. 23, 2005.

FIELD OF THE INVENTION

The invention relates to an axial flow turbine motor of the type including a rotor provided with one or more peripheral rows of drive blades and a peripheral band-shaped wall element radially clamped against the tops of the drive blades, and a stator provided with inlet nozzles for a motive pressure medium and having an annular inner surface surrounding the rotor.

BACKGROUND OF THE INVENTION

A problem concerned with turbine motors is the difficulty to accomplish a simple yet reliable overspeed preventing safety device by which the rotor is prevented from reaching hazardous high speed levels where damage to equipment and operator injuries may be caused. Normally a safe and suitable speed is provided by a speed governor of any suitable type, but in case of a speed governor malfunction there has to be an independently operating overspeed preventing device fitted to protect the operator and other equipment from damage and injury. Since turbine motors operate at very high speed levels it is very difficult to design a reliable and safely operating overspeed preventing device of the type comprising a mechanical speed responsive actuator and a pressure medium shut-off valve. Such an actuator/valve arrangement is also rather complex in design and costly to manufacture as it contains many parts which require expensive machining.

OBJECT OF THE INVENTION

It is the main object of the invention to create an axial flow turbine motor with a simple and quite cheap yet effective overspeed preventing safety device.

Further objects and advantages of the invention will appear from the following specification and claims.

Preferred embodiments of the invention are described below with reference to the accompanying drawings.

DETAILED DESCRIPTION

Figure 1:
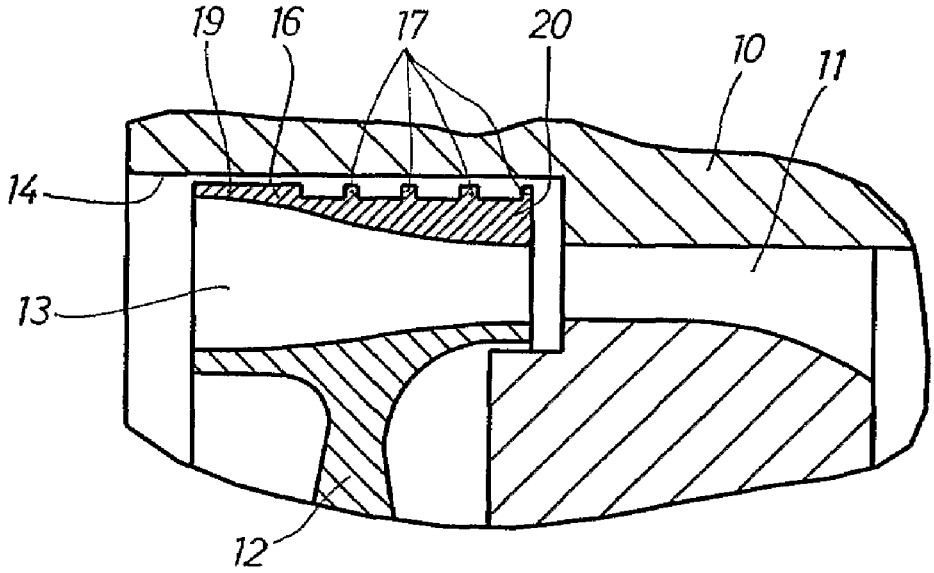
FIG. 1 shows a fractional view of a pneumatic turbine having an overspeed protecting device according to the invention.
Figure 2:
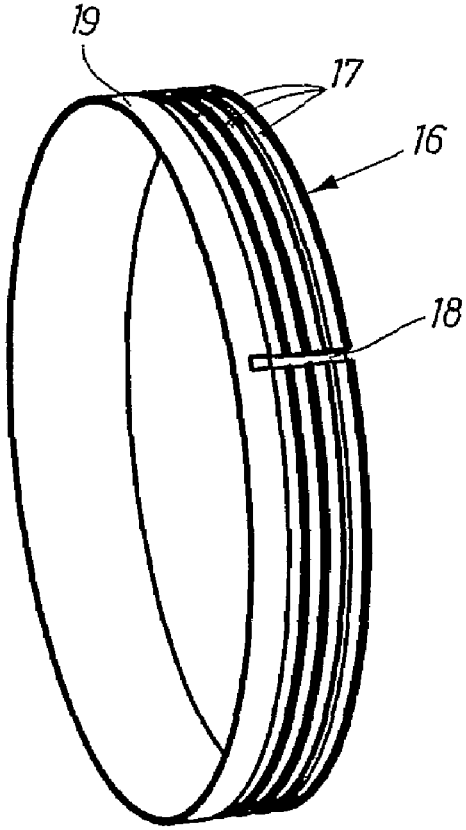
FIG. 2 shows a perspective view of a drive blade covering band according to the invention.

In FIGS. 1 and 2 there is shown an example illustrating the invention. Accordingly, the drawing figures show a pneumatic single stage turbine including a housing 10 with at least one pressure air nozzle 11, and a rotor 12 journalled in the housing 10 and comprising a single circumferential row of drive blades 13. The housing 10 is formed with an annular inner surface 14 which surrounds the rotor 12 and the rotor blades 13, and the air nozzle 11 is arranged to direct a substantially axial flow of pressure air onto the drive blades 13 at an inlet end of the latters to thereby drive the rotor 12. The pressure air leaves the blades 13 at an outlet end thereof at a lower pressure.

The turbine motor according to the invention is equipped with a non-illustrated speed governor of any suitable type to keep the rotor speed at a desired level. This is essential for example in grinder applications where the rotation speed of a grinding tool shall be kept at a certain level for obtaining the most efficient grinding operation and the longest possible service life of the grinding tool. In such applications it also very important that the rotor speed is safely prevented from reaching any higher speed levels, since there will be a risk of grinding tool disintegration or explosion. In order to ensure that such high speed levels will not be reached, even if the speed governor should malfunction, the turbine has to be provided with an independently operating overspeed preventing device which will come into action only at speed levels well above the speed level normally ensured by the speed governor.

On the periphery of the rotor 12, i.e. on tops of the drive blades 13, there is mounted an endless cover band 16 forming a wall element around the drive blades 13. One purpose of this band 16 is to accomplish a favourable air flow through the rotor blades 13 to enhance the efficiency of the turbine. In order to obtain an expanding air flow through the drive blades 13 the latters are formed with a larger radial extent at their outlet ends, which means that the cover band 16 has a larger inner diameter at the outlet end of the drive blades 13. Accordingly, the cover band 16 has a large diameter portion 19 at the outlet ends of the drive blades 13 and a reduced diameter portion 20 at the inlet ends of the drive blades 13. On the outside of the reduced diameter portion 20 On its outside the cover band 16 is formed with a number of circumferential ribs 17 for reducing air leakage around the rotor 12.

According to the invention, the band 16 is intended to form an overspeed protective device by being formed of a suitable material and having suitable dimensions to yield under centrifugal action at rotor speed levels exceeding that normally provided by the speed governor. When a too high speed level is reached the band 16 will yield and expand in such a way that it looses its contact with the drive blades 13. Then, the band 16 is displaced by the pressure difference across the drive blades 13 in the direction of the air flow such that it will get jammed between the annular surface 14 of the housing 10 and the drive blades 13. Thereby, the band 16 will generate a braking force on the rotor 12 and prevent the latter from reaching hazardous high speed levels. As illustrated in FIG. 2 the band 16 could be provided with weakening grooves 18 to enhance yielding of the band 16. In FIG. 2 only one groove 18 is visible, but there is at least one more groove located so as to ensure a perfect balancing of the band 16.

Figure 3:
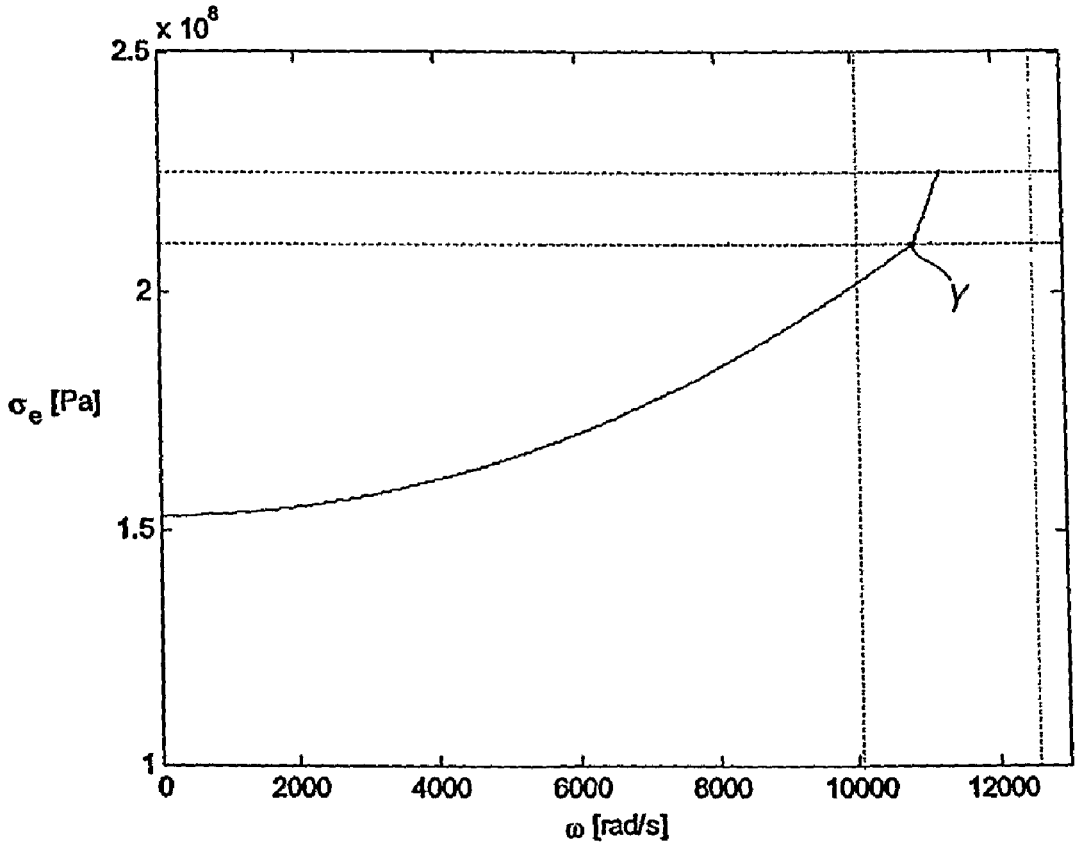
FIG. 3 shows a diagram illustrating the strain in the drive blade covering band in relation to rotor speed.

The curve in the diagram shown in FIG. 3 illustrates how the strain related expansion of the band 16 increase as the rotation speed of the rotor 12 increases, and at a certain point Y above 10000 rad/sec the band 16 suddenly starts yielding, suitably in one or more of the grooves 18. This means that the expansion of the band 16 suddenly starts increasing more rapidly. This is indicated by a discontinuity of the curve which is quite significant and makes it possible to determine with a good accuracy the speed level at which the overspeed preventing device will come into action. This speed level could easily be separated from the speed level normally provided by the speed governor, which in this example is below 10000 rad/sek.

As a result of passing the yield point Y for the cover band material yielding or even rapture of the band 16 will occur, which means that the band 16 expands and separates from the drive blades 13. Then, the band 16 is displaced axially by the pressure drop across the drive blades 13 and gets jammed between the blades 13 and the housing surface 14. Instead of reaching any hazardous high speed levels the rotor 12 is now braked down to a safe speed level or even stopped.

In the illustrated example the band 16 is made of an aluminium alloy and is clamped onto the drive blades 13 by a shrinking process. However, the band 16 could be made of a plastic material, and instead of shrinking the band 16 could be mounted on the rotor drive blades 13 by a press fit.

The invention claimed is:

1. An axial flow turbine motor, comprising:

a rotor with a peripheral row of drive blades, a peripheral band-shaped wall element radially clamped against tops of the drive blades, and a stator with at least one pressure medium inlet nozzle and an annular inner surface surrounding the rotor, wherein said wall element is arranged to withstand centrifugal forces and to uphold clamping engagement with the drive blades up to a predetermined speed level of said rotor but to expand and loosen the clamping engagement with the drive blades and move into contact with the annular housing surface at speed levels above said predetermined speed level, thereby preventing the rotor from reaching hazardous high speed levels.

2. The turbine according to claim 1, wherein said wall element comprises at least one weakening portion adapted to rupture at speed levels above said predetermined speed level, thereby causing the wall element to split up and interfere with the rotational movement of the rotor.

3. The turbine according to claim 1, wherein said wall element has a large diameter portion and a reduced diameter portion, and wherein at least one peripheral rib is located at said reduced diameter portion and has a same outer diameter as said large diameter portion.

4. The turbine according to claim 2, wherein said wall element has a large diameter portion and a reduced diameter portion, and wherein at least one peripheral rib is located at said reduced diameter portion and has a same outer diameter as said large diameter portion.

* * * * *